US008727750B2

(12) United States Patent
Lu et al.

(10) Patent No.: US 8,727,750 B2
(45) Date of Patent: May 20, 2014

(54) HOT SWAP FAN MODULE

(75) Inventors: Ja-Jeng Lu, Taoyuan Hsien (TW); Peng-Chu Tao, Taoyuan Hsien (TW); Te-Tsai Chuang, Taoyuan Hsien (TW); Wen-Shi Huang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 11/266,304

(22) Filed: Nov. 4, 2005

(65) Prior Publication Data

US 2006/0099092 A1 May 11, 2006

(30) Foreign Application Priority Data

Nov. 5, 2004 (TW) ..... 93133827 A

(51) Int. Cl.
*F04B 35/04* (2006.01)

(52) U.S. Cl.
USPC ..... 417/423.14

(58) Field of Classification Search
USPC ..... 417/423.1, 423.14, 424.2; 415/213.1; 454/184; 361/727, 732, 740, 754, 755, 361/759, 695; 16/422, 429, 438, 268; 74/528, 543–548, 164; 165/80.1, 80.3, 165/80.2
See application file for complete search history.

(56) References Cited

U.S. PATENT DOCUMENTS

| | | | | |
|---|---|---|---|---|
| 5,788,566 | A * | 8/1998 | McAnally et al. | 454/184 |
| 6,236,564 | B1 * | 5/2001 | Fan | 361/695 |
| 6,373,698 | B1 * | 4/2002 | Christensen | 361/695 |
| 6,381,139 | B1 * | 4/2002 | Sun | 361/725 |
| 6,435,889 | B1 * | 8/2002 | Vinson et al. | 439/247 |
| 6,556,437 | B1 * | 4/2003 | Hardin | 361/687 |
| 6,565,163 | B2 * | 5/2003 | Behl et al. | 312/223.1 |
| 6,592,327 | B2 * | 7/2003 | Chen et al. | 415/213.1 |
| 6,708,372 | B2 * | 3/2004 | Stewart | 16/422 |
| 6,749,398 | B2 * | 6/2004 | Lu et al. | 415/121.2 |
| 2002/0015648 | A1 * | 2/2002 | Kosugi | 417/423.14 |
| 2003/0035724 | A1 * | 2/2003 | Chen et al. | 415/213.1 |
| 2003/0099094 | A1 * | 5/2003 | Coles et al. | 361/726 |

FOREIGN PATENT DOCUMENTS

| | | | |
|---|---|---|---|
| CN | 1425965 | A | 6/2003 |
| JP | 2003-9469 | A | 1/2003 |
| JP | 2004-235257 | A | 8/2004 |

* cited by examiner

*Primary Examiner* — Devon Kramer
*Assistant Examiner* — Amene Bayou
(74) *Attorney, Agent, or Firm* — Birch, Stewart, Kolasch & Birch, LLP

(57) ABSTRACT

A hot swap fan includes a fan and a puller structure. The puller structure covers a side surface of the fan. The puller structure includes a base, a holder, and a fixing structure. A first end of the base is pivoted to the fan. The holder and the fixing structure are on a second end of the base.

16 Claims, 5 Drawing Sheets

HOT SWAP FAN MODULE

BACKGROUND OF THE INVENTION

1. Field of the Invention

The present invention relates to a hot swap fan and a puller structure thereof, and a fan module with a hot swap fan.

2. Description of the Related Art

When an electronic device is in operation, heat produced increases ambient temperature in the entire system, affecting stability and possibly causing system failure. A heat-dissipating device, such as a heat-dissipating fan, is used to stabilize system operating under a stabilized ambient temperature. In order to avoid system shutdown when replacing damaged fans, a hot swap fan is developed to allow the system to operate in 24 hours.

However, the heat dissipating fan is arranged in limited space within the system. Simplifying components to allow the fan to be assembled with hot swap ability is needed.

BRIEF SUMMARY OF INVENTION

The objective of the invention is to provide a hot swap fan, with simplified structure to provide fast assembly, to reduce volume, and to reduce fabrication costs. In addition, connectibility and manufacturing tolerance between a contact terminal and a corresponding terminal of the system are enhanced.

Another objective of the invention is to provide a hot swap fan with more convenience and more safety.

Accordingly, the invention provides a hot swap fan module comprising a fan and a puller structure. The puller structure attaches to a side surface of the fan, comprising a base, a holder, and a fixing structure, wherein a first end of the base pivots on the fan. The holder and the fixing structure are on a second end of the base.

The invention further provides a puller structure for a hot swap fan, comprising a base, a holder, and a fixing structure, wherein the holder and the fixing structure are on the first end of the base.

The invention farther provides a hot swap fan module, comprising a fan cage, a fan, and a puller structure. The fan is received on the fan cage, and the puller structure attaches to a side surface of the fan. The puller structure comprises a base, a holder, and at least one fixing structure. A first end of the base pivots on the fan, and the holder and the fixing structure are on a second end of the base. The fan and the fan cage are engaged or separated by the fixing structure.

The fixing structure is a tenon or a depression structure, and the holder is a holding ring. The puller structure is plastic or metal. The previously described hot swap fan module farther comprises a first connecting structure and a second connecting structure, wherein the first connecting structure is on the first end of the puller structure, and the second connecting structure is on the fan. The first connecting structure connects with the second connecting structure correspondingly. In addition, the first connecting structure and the second connecting structure are connecting holes, a latch structure, a fixing structure, a lock structure, or protruding points. In the previously described fan module, the holder and the base are of substantially the same height.

The hot swap module further comprises a terminal base fixed on other sides of the fan. The terminal base has a plurality of protruding points engaging the fan. Besides, the previously described hot swap fan module further comprises a fan guard covering the fan. The fan guard has a U-shaped section. In addition, an outer surface of the fan guard forms a connecting hole and a venting hole, wherein the venting hole is polygonal, circular, elliptic, a regular pattern or an irregular pattern. The outer surface of the fan guard has a protrusion. The fan guard is fixed on the fan by riveting or screwing.

The puller structure further comprises a bent portion on the second end of the base. The holder is formed on a front surface of the bent portion facing the first end of the base, and the fixing structure is formed on a back surface of the bent portion. The base and the bent portion are integrally formed as a single piece. The bent portion has a V-shaped section or a U-shaped section. The back surface of the bent portion comprises at least one protrusion or at least one depression corresponding to the fixing structure.

The bent portion can be formed of a first portion and a second portion. An included angle is formed between the first portion and the second portion. The first portion connects with the base, and the second portion has the holder and the fixing structure. The first portion connects with the base with an angle formed therebetween, and forms a rib structure. The holder is positioned away from the base by a distance in height, equaling the height of the second portion.

The bent portion has the holder on an end of the bent portion near the base, and the engaging portion on other end of the bent portion. The fixing structure faces the fan, or reversely faces the fan. The holder pivots on the second end of the base, and moves on the base, and the fixing structure moves with the holder. The holder moves in a rotatable manner, moves up and down, moves left and right, or moves forward and backward.

The fan comprises an input/output terminal, a signal terminal, or a signal light. The base is a flat structure, or a flat structure with a bent end.

In the hot swap fan module, the fan cage comprises another fixing structure corresponding to the fixing structure. In addition, the fan cage comprises an input/output terminal, a signal terminal, or a signal light. The fan cage is detachably or integrally formed within the system. When the holder is in a first position, the first fixing structure connects with the second fixing structure. When the holder is in a second position, the first fixing member separates from the second fixing member. When a fan is assembled on the fan cage, the fixing structure is engaged with the fan cage or separated from the fan cage from an interior or an exterior of the fan cage. The fan cage further comprises at least one fixing base receiving the fan. When the number of the fixing base is plural, the fixing bases are in an arrangement of an array, or a line.

In the invention, the end of the puller structure pivots on the fan, and the other end of the puller structure has a holding ring on the bent portion. Only one puller structure is needed, by using a finger, the fan can be quickly assembled or disassembled. The simplified structure of the hot swap fan minimizes the overall volume and cost at the same time. Further, the holding ring is formed on the bent portion, such that the elasticity of the puller structure reduces the gap between a contacting terminal and a corresponding terminal of the system, enhancing the connectibility and manufacturing tolerance between the two.

In addition, the fan guard and the puller structure are integrated into the hot swap fan. Only a small amount of additional space is required for the system to be firmly covered, and to be more convenient and safe.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION OF INVENTION

Figure 1:
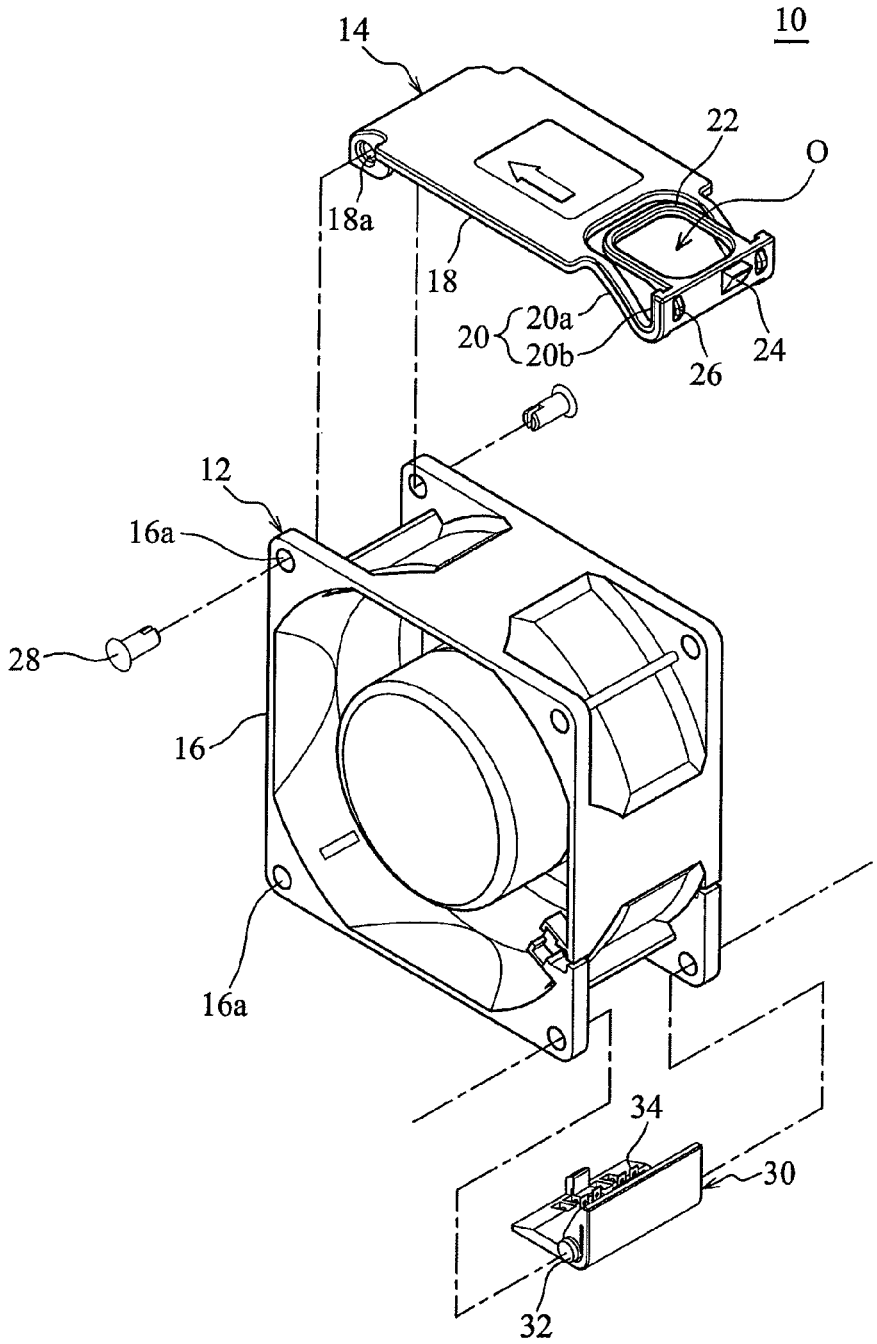
FIG. 1 is an exploded view of an embodiment of an hot swap fan module of the present invention.

FIG. 1 is an exploded view of an embodiment of a hot swap fan module 10 of the present invention.

As shown in FIG. 1, the hot swap fan module 10 comprises a fan 12 and a puller structure 14. The fan 12 has an inlet surface, an outlet surface, and a side surface connecting the inlet surface and the outlet surface. A plurality of connecting holes 16*a* is formed on a frame 16 of the fan 12.

The puller structure 14 is elastic/flexible material, such as metal or plastic. In order to match the appearance of the frame 16, the puller structure 14 comprises a base 18 and a bent portion 20 on an end of the base 18, disposed on the side surface of the fan 12. The side surface of the fan 12 may be a top-surface of the side surface of the fan 12.

An other end of the base 18 has a pivoting hole 18*a* for pivoting an end of the puller structure 14 on the frame 16 of the fan 12. The base 18 can be a flat structure, or a flat structure with a bent end. The pivoting hole 18*a* is corresponding with the connecting holes 16*a*.

The bent portion 20 comprises an included angle, such that a V-shape or a U-shape section is formed therein. The bent portion 20 comprises a first portion 20*a* and a second portion 20*b*. The first portion 20*a* connects to the base 18 with an angle formed therebetween allowing the puller structure 14 to match the appearance of the frame 16. In this embodiment, the first portion 20*a* is formed by two parallel ribs connected with the base 18. The second portion 20*b* has a holder, such as a holding ring 22, on a front surface facing a pivoting end of the base 18. In addition, a central opening O is formed on the holding ring 22, allowing a user to insert a finger so that only one end of the base 18 pivots on the fan 12 to rotate the base 18. A fixing structure, such as a fixing structure, a tenon 24 or a depression, is formed on a back surface of the second portion 20*b*. The fixing structure can be formed by the bent portion 20 or the holding ring 22. Further, a protrusion 26 or depression is formed on the back surface of the second portion 20*b*. The tenon 24 and the protrusion 26 are at the same horizontal level. When the tenon 24 firmly attaches with the notch of the fan cage, the protrusion 26 on the same level of the tenon 24 absorbs shock and provides fool-proof function. However, when no shock absorption or fool-proof function is provided by the hot swap fan module 10, the protrusion 26 can be eliminated.

In this embodiment, the holding ring 22 horizontally extends toward the base 18. The holding ring 22 and the base 18 can be substantially at the same horizontal level.

When a user uses a finger inserting the holding ring 22, then applies a force in a direction toward the base 18 of the puller structure 14, because the puller structure 14 has elasticity, the holding ring 22 moves toward the base 18, causing the second portion 20*b* to approach the first portion 20*a*, and the tenon 24 separates from a notch of a fan cage (not shown). At the same time, because the end of the puller structure 14 corresponding to the bent portion 20 pivots on the fan 12, the puller structure 14, in which the tenon 24 is separated from the notch, can rotate upwardly around the pivoting end, raising the fan 12 to disassemble the fan 12 from the fan cage. To assemble the hot swap fan module 10 with the notch of the fan cage, the elasticity of the first portion 20*a* and the second portion 20*b* provides accurate down pressure for the tenon 24 to engage with the notch.

In the invention, the end of the puller structure 14 pivots on the fan 12, and the other end of the puller structure 14 has a holding ring 22 on the bent portion 20. Only one puller structure 14 is needed, by using a finger, the hot swap fan module 10 can be effectively assembled or disassembled to the fan cage. The simplified structure of the hot swap fan module 10 minimizes overall volume and costs at the same time. Furthermore, the holding ring 22 is formed on the bent portion 20, such that elasticity (between the first portion 20*a* and the second portion 20*b*) of the bent portion 20 allows firm contact between a contacting terminal (tenon 24 or depression) and a corresponding terminal (the fixing structure of the fan cage corresponding to the tenon 24 or the depression) of the system, enhancing the connectibility and the manufacturing tolerance between the two.

The bent portion 20 can be more like a can opener. A holder is formed on an end of the bent portion 20 near the end of the base 18, and a fixing structure is formed on other end of the bent portion 20. On the other hand, an end of the holder can pivot on the end of the base 18 (the end not pivoting on the fan 12), and the fixing structure can be directly located on another end of the holder. The holder can move on the base 18, wherein the holder moves in a rotatable manner, moves up and down, moves left and right, or moves forward and backward. When the holder moves, the fixing structure moves with the holder directly or indirectly. A first fixing structure is on other end of the holder, and the base comprises a second fixing structure corresponding to the first fixing structure. When the holder is in a first position, the first fixing structure connects with the second fixing structure; when the holder is in a second position, the first fixing member separates from the second fixing member.

A terminal base 30 can be disposed on a side surface, opposite to the puller structure 14, of the hot swap fan module 10. A plurality of coupling terminals 34 of the terminal base 30 can couple to the system. A protruding point 32 is formed on the terminal base 30. The protruding point 32 engages with the connecting hole 16*a* of the frame 16 to fix the terminal base 30.

Figure 2:
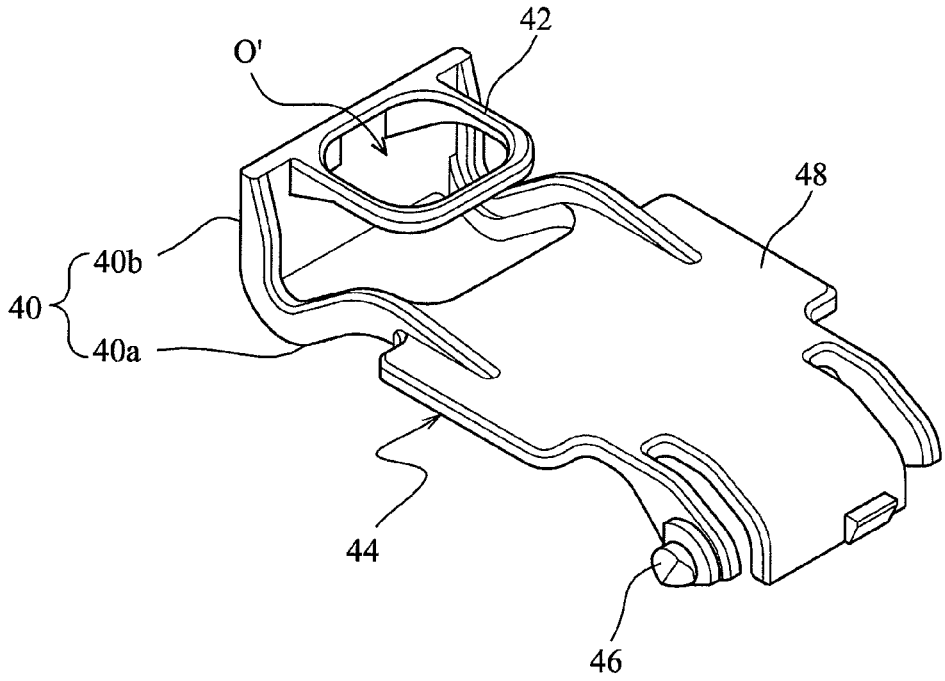
FIG. 2 is a schematic view of a variant embodiment showing a puller structure of the hot swap fan module of the present invention.

In the embodiment, the holding ring 22 is substantially on the same horizontal level of the base 18 of the puller structure 14 to minimize the overall volume of the hot swap fan module 10, but it is not limited thereto. The holding ring 22 can be designed according to actual demand. As shown in FIG. 2, the holding ring 42 formed on the puller structure 44 and the base 48 of the puller structure 14 are not on the same horizontal level. A difference in height between the two increases the holding stability. In addition, the difference in height can be the height of the second portion 40*b* of the bent portion 40. So the holding ring 42 is positioned away from the base 48 by a distance in height. Additionally, a central opening O' is formed on the holding ring 42 allowing a user to insert a finger so that only one end of the base 48 pivots on the fan 12 to rotate the base 48.

The end of the puller structure 14 pivotal connects with the frame 16 of the fan 12, but connection thereof is not limited. As shown in FIG. 1, the end of the puller structure 14 has a pivoting hole 18*a*, and the frame 16 of the fan 12 has a connecting hole 16*a*, wherein the pivoting hole 18*a* and the connecting hole 16*a* are connected by a rivet 28. Otherwise, the rivet 28 can be a screw structure, or a structure with a hook. As shown in FIG. 2, a protruding point 46 is formed on the puller structure 44 to be a fixing structure corresponding to the connecting hole 16*a* of the frame 16. By engaging the protruding point 46 and the connecting hole 16*a* with a minor gap therebetween, pivoting is successfully achieved. Alternatively, the protruding point can be formed on the frame 16 to be a fixing structure corresponding to the pivoting hole 18*a*. By engaging the protruding point and the pivoting hole 18*a* with a minor gap therebetween, pivoting is successfully achieved as well. Additionally, commonly used latch or lock structures can also be used to insert into the pivoting hole 18*a* and the connecting hole 16*a*, simultaneously.

It is noted that the base 18 and the bent portion 20 of the puller structure 14 are integrally formed as a single piece, but are not limited thereto. They can be fabricated separately, and assembled.

Figure 3:
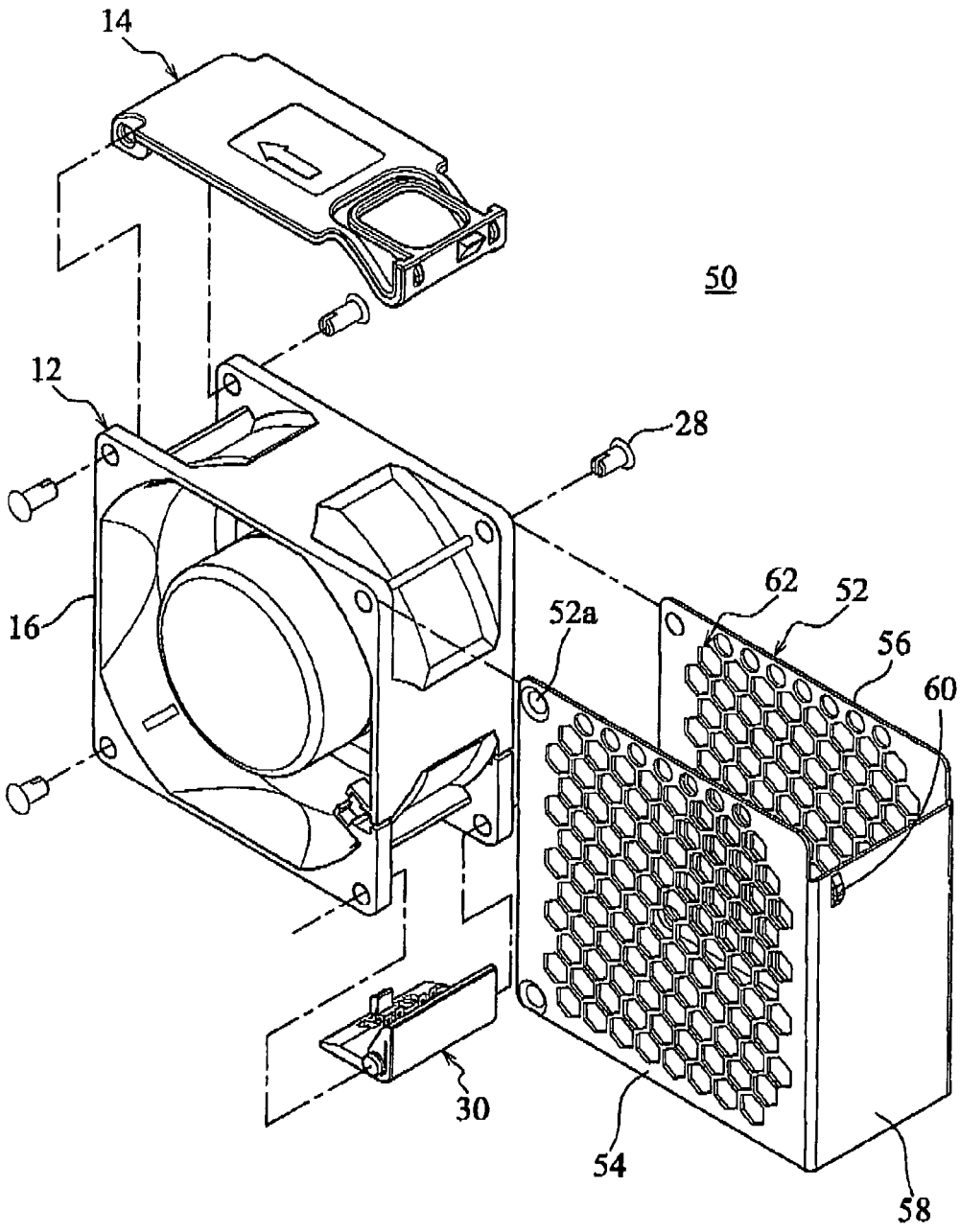
FIG. 3 is an exploded view of another variant embodiment of the hot swap fan module of the present invention.

FIG. 3 is an exploded view of another variant embodiment of the hot swap fan module 50 of the invention. To prevent accidentally cutting by rotating blades of the fan, a fan guard 52 is added on the inlet/outlet sides of the fan to enhance safety. This embodiment of the invention comprises a fan guard 52 firmly disposed on the hot swap fan module 50. As shown in FIG. 3, the fan guard 52 comprises larger surfaces 54, 56, and a connecting surface 58 connecting the surfaces 54 and 56, forming a U shaped section. The surfaces 54 and 56 cover the inlet side and the outlet side of the fan 12 to provide protection. A plurality of connecting holes 52 is formed on the surfaces 54, 56 of the fan guard 52. By riveting, engaging, pivoting, or screwing, the fan guard 52 is firmly connected with the frame of the fan 12 to form a safe hot swap fan module 50. Additionally, a protrusion 60 can be formed on the connecting surface 58 to provide fool proof feature. The connecting surface 58 needs only firmly connect the surfaces 54, 56, and the height of the connecting surface 58 can be equal to, higher than or, lower than that of the surfaces 54, 56. A plurality of venting holes 62 can be formed on the surfaces 54, 56 of the fan guard 52, and the shape of the venting holes 62 can be polygonal, circular, regular pattern, or irregular pattern.

Figure 4:
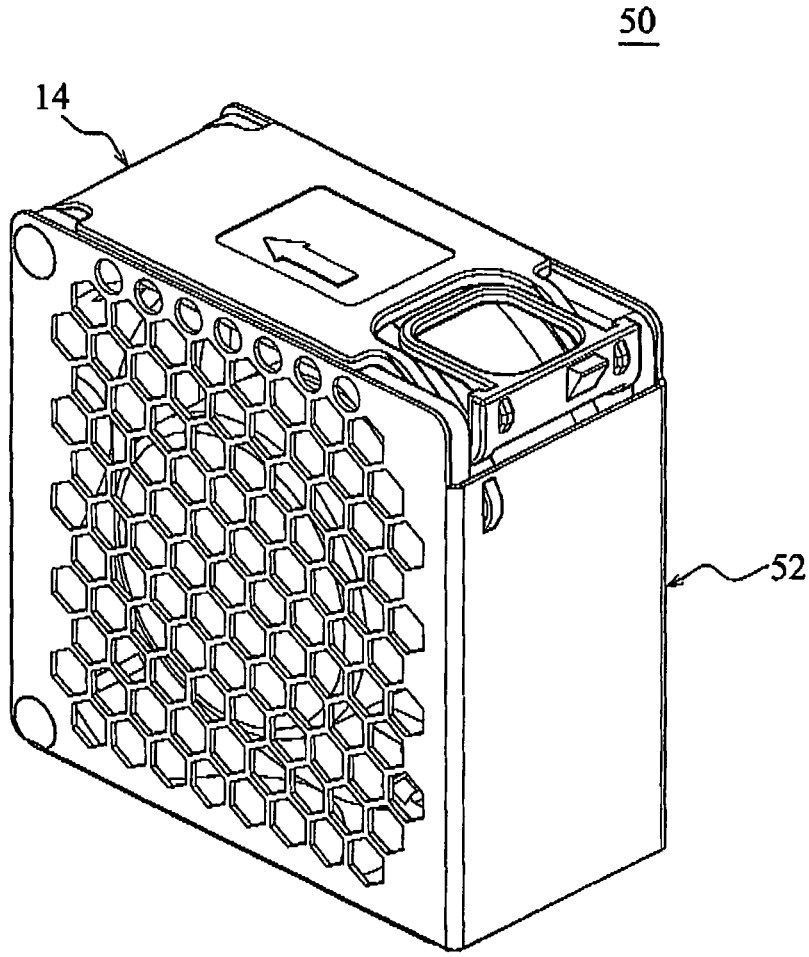
FIG. 4 is a schematic view of the hot swap fan with a fan guard of the present invention.

FIG. 4 is a schematic view of the hot swap fan 50 with a fan guard 52. The fan guard 52 is designed to match the puller structure 14, such that only minimal volume is required allowing the module to be firmly covered. Material of the fan guard 52 is not limited as long as it can provide safety, and can be, for example, metal or plastic.

Figure 5:
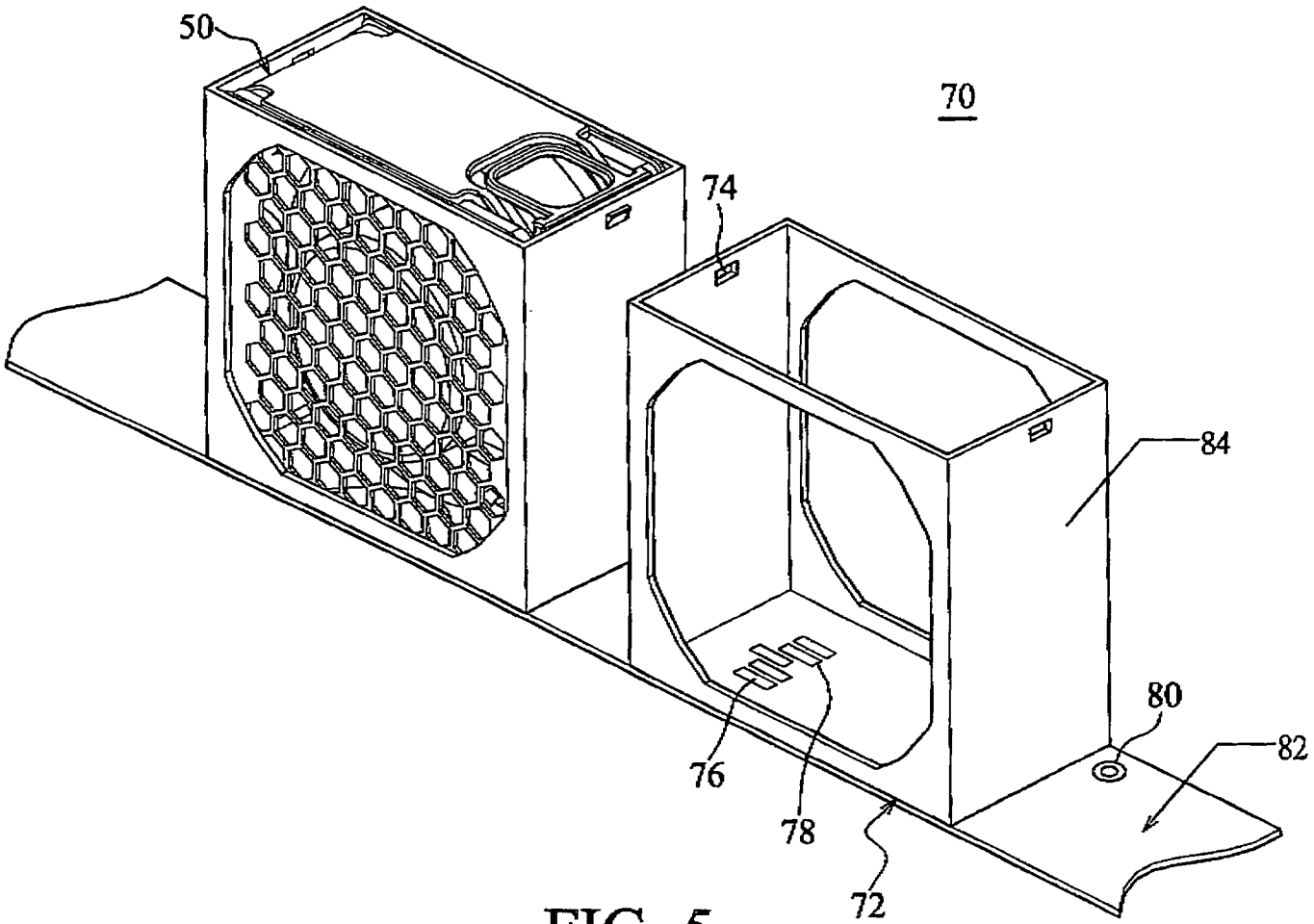
FIG. 5 is a schematic view of a fan module and a fan cage of the present invention.

FIG. 5 is a schematic view of a fan module 50 and a fan cage 72. The hot swap fan module 50 can be disposed on a fixing base 84 of the fan cage 72 (or a fan cage 72 of an external system 82) to form a new fan module 70. As shown in FIG. 5, a notch 74 is formed on the fan cage 72, receiving a tenon 24 of the hot swap fan. A plurality of hot swap fans can be disposed on the fan cage 72 at the same time. The fan cage 72 has an input/output terminal 76, and a signal terminal 78. The input/output terminal 76 and the signal terminal 78 couple to the coupling terminal 34 of the terminal base 30. A signal light 80 can also be formed on the fan cage 72 to show the operating condition of the hot swap fan. In FIG. 5, a tenon 24 engages with the notch 74 of the fan cage to fix the hot swap fan module 50, but fixing method is not limited thereto. For example, a tenon rather than a notch can be formed on the fan cage 72, and an opening corresponding to the tenon can be formed on the hot swap fan to receive the tenon of the fan cage 72, same fixing result is achieved. The fan cage 72 can connect with the external system 82, or be integrally formed with the external system 82 as a single piece, When the number of the fixing bases is plural, the fixing bases are in an arrangement of an array, a line, or other disposition.

Furthermore, the input/output terminal 76, the signal terminal 78, and the signal light 80 can be formed on the fan 12 or the puller structure 14.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A hot swap fan module that is configured to be installed on a fan cage, comprising:

a fan; and a puller structure disposed on a side of the fan, comprising a base, a holder, and a fixing structure, wherein a first end of the base pivots on the fan, and the holder and the fixing structure are on a second end of the base opposite to said first end, characterized in that said puller structure is formed of an elastic or flexible material, wherein a bent portion is formed at said second end of said base, wherein said fixing structure is formed at a back surface of said bent portion and wherein said holder is disposed at a front surface of said bent portion, which faces said first end of said basis, wherein when the holder is subjected to a pulling force directed toward the first end of the base, the fixing structure separates from the fan cage and the fan is disengaged from the fan cage.

2. The hot swap fan module as claimed in claim 1, wherein the base and the bent portion are configured as an integral single piece structure.

3. The hot swap fan module as claimed in claim 1, wherein the bent portion has a V-shaped or U-shaped section.

4. The hot swap fan module as claimed in claim 1, wherein the back surface of the bent portion comprises at least one protrusion or at least one depression.

5. The hot swap fan module as claimed in claim 1, wherein the bent portion comprises a first portion connected with the base and a second portion provided with the holder and the fixing structure, wherein an acute angle is included between the first portion and the second portion.

6. The hot swap fan module as claimed in claim 1, further comprising:

a first connecting structure disposed on the first end of the puller structure; and a second connecting structure disposed on the fan;

wherein the first connecting structure connects with the second connecting structure correspondingly.

7. The hot swap fan module as claimed in claim 1, further comprising a terminal base fixed on a side of the fan, opposite to the puller structure.

8. The hot swap fan module as claimed in claim 1, further comprising a fan guard covering the fan, and the fan guard comprising a fool-proof protrusion, and a venting hole, wherein the venting hole is polygonal, circular, elliptical, a regular pattern, or an irregular pattern.

9. The hot swap fan module as claimed in claim 1, wherein the holder and the base are substantially on the same horizontal level, or the holder is positioned away from the base by a distance in height.

10. The hot swap fan module as claimed in claim 1, wherein the holder pivots on the second end of the base and moves on the base, and the fixing structure moves along with the holder.

11. The hot swap fan module as claimed in claim 10, wherein the holder moves in a rotatable manner, moves up and down, moves left and right, or moves forward and backward.

12. The hot swap fan module as claimed in claim 1, wherein the fan comprises an input/output terminal, a signal terminal, or a signal light.

13. The hot swap fan module as claimed in claim 1, wherein the base is a flat structure, or a flat structure with a bent end.

14. The hot swap fan module as claimed in claim 1, wherein the fan cage further comprises at least one fixing base receiving the fan, a first fixing structure is on one end of the holder, and the fixing base has at least one second fixing structure corresponding to the first fixing structure.

15. The hot swap fan module as claimed in claim 14, wherein the number of the fixing base is plural, the fixing bases are in an arrangement of an array or a line.

16. The hot swap fan module as claimed in claim 1, wherein the fan cage is detachably or integrally formed within the hot swap fan module.

* * * * *